US009586733B2

(12) United States Patent
Garza

(10) Patent No.: US 9,586,733 B2
(45) Date of Patent: Mar. 7, 2017

(54) PRESSURE-FITTED INSERTABLE DRINKING SPOUT ADAPTED FOR VARYING BOTTLE NECK SIZES

(71) Applicant: Ubaldo Garza, Porterville, CA (US)

(72) Inventor: Ubaldo Garza, Porterville, CA (US)

( * ) Notice: Subject to any disclaimer, the term of this patent is extended or adjusted under 35 U.S.C. 154(b) by 84 days.

(21) Appl. No.: 14/726,484

(22) Filed: May 30, 2015

(65) Prior Publication Data

US 2016/0016704 A1 Jan. 21, 2016

Related U.S. Application Data

(60) Provisional application No. 61/998,414, filed on Jun. 27, 2014, provisional application No. 62/051,308, filed on Sep. 17, 2014.

(51) Int. Cl.

| | |
|---|---|
| ***B65D 47/00*** | (2006.01) |
| ***B65D 47/14*** | (2006.01) |
| ***B65D 51/24*** | (2006.01) |
| ***B65D 51/28*** | (2006.01) |
| ***B65D 1/06*** | (2006.01) |

(52) U.S. Cl.

CPC ..... *B65D 47/14* (2013.01); *B65D 1/06* (2013.01); *B65D 51/24* (2013.01); *B65D 51/245* (2013.01); *B65D 51/28* (2013.01); *B65D 2251/08* (2013.01)

(58) Field of Classification Search

CPC ..... A47J 31/605; A47J 31/446; B01D 36/02; B65D 47/14; B65D 51/18; B65D 51/28

USPC ..... 215/227

See application file for complete search history.

(56) References Cited

U.S. PATENT DOCUMENTS

| | | | | | |
|---|---|---|---|---|---|
| 4,132,225 | A * | 1/1979 | Whattam | A61B 5/1411 | 215/306 |
| 4,583,668 | A * | 4/1986 | Maynard, Jr. | B65D 25/48 | 141/367 |
| 4,813,563 | A * | 3/1989 | Ogden | B65D 39/0076 | 215/253 |
| 4,832,238 | A * | 5/1989 | Taylor | B65D 25/48 | 141/337 |
| 4,924,899 | A * | 5/1990 | Po | A63H 3/06 | 137/232 |
| 4,971,211 | A * | 11/1990 | Lake | A61J 9/00 | 215/11.1 |
| 5,020,702 | A * | 6/1991 | James | B67D 3/047 | 141/337 |
| 5,090,583 | A * | 2/1992 | Hoffman | B65D 47/147 | 215/250 |
| D330,856 | S * | 11/1992 | Kidd | D9/451 | |
| D330,857 | S * | 11/1992 | Kidd | D9/451 | |
| 5,295,599 | A * | 3/1994 | Smith | B01L 3/50825 | 215/204 |

(Continued)

*Primary Examiner* — Anthony Stashick
*Assistant Examiner* — Ernesto Grano
(74) *Attorney, Agent, or Firm* — Law Office of Dorian Cartwright; Dorian Cartwright

(57) ABSTRACT

A drinking cap dispense liquid from and to reseal any of a plurality of bottles having bottle necks of varying sizes. A sealing portion of the cap seals in liquid to prevent spilling. The sealing portion can have a cone shape with a first diameter on a lower portion and a second diameter on an upper portion that is larger than the first diameter, to seal bottles of different sizes. A sipping portion provides a spout for consuming or pouring liquid. An attached cover of the cap adapted for closes the sipping portion.

8 Claims, 8 Drawing Sheets

(56) References Cited

U.S. PATENT DOCUMENTS 5,502,981 A * 4/1996 Sullivan ..... A47G 23/04 220/522
5,636,740 A * 6/1997 Finkiewicz ..... B65D 47/0842 206/457
5,657,792 A * 8/1997 Prest ..... F16L 55/1152 138/89
5,702,025 A * 12/1997 Di Gregorio ..... B65D 47/28 220/714
D391,852 S * 3/1998 Tucker ..... D9/451
5,840,185 A * 11/1998 Hughes ..... B01D 35/04 210/232
6,004,460 A * 12/1999 Palmer ..... C02F 1/003 210/209
6,117,319 A * 9/2000 Cranshaw ..... A47J 31/605 210/232
6,468,435 B1 * 10/2002 Hughes ..... B01D 35/02 210/110
D471,060 S * 3/2003 Salsman ..... D7/392.1
6,565,743 B1 * 5/2003 Poirier ..... B65D 51/00 116/284
D560,097 S * 1/2008 Shen ..... D7/300
D601,311 S * 9/2009 DeSeguirant, Jr. ..... D30/160
D624,153 S * 9/2010 Shani ..... D23/207
D663,575 S * 7/2012 Carroll ..... D7/392
8,701,907 B1 * 4/2014 Mallicoat ..... B65D 51/245 215/228
9,115,823 B1 * 8/2015 Smith ..... B60C 29/00
D741,176 S * 10/2015 Bell ..... D9/446
2003/0178433 A1 * 9/2003 Adams ..... B65D 47/0895 220/703
2004/0007594 A1 * 1/2004 Esch ..... B65D 51/28 222/145.1
2005/0279768 A1 * 12/2005 Chatrath ..... B01D 61/18 222/189.06
2006/0151414 A1 * 7/2006 Mullen ..... B65D 1/0223 215/227
2006/0151426 A1 * 7/2006 Peters ..... A47G 19/2272 215/387
2008/0000898 A1 * 1/2008 Ramsden ..... B65D 51/28 220/4.26
2008/0023433 A1 * 1/2008 Romero ..... B67B 7/18 215/304
2009/0145874 A1 * 6/2009 Hite ..... B65D 23/0878 215/227
2009/0184083 A1 * 7/2009 Cho ..... B65D 47/06 215/227
2010/0237002 A1 * 9/2010 Shani ..... B01D 61/18 210/236
2011/0278216 A1 * 11/2011 Hull ..... A47G 19/2266 210/236
2011/0303561 A1 * 12/2011 Zheng ..... B01F 13/002 206/219
2012/0090699 A1 * 4/2012 Lau ..... F16K 15/202 137/231
2013/0032566 A1 * 2/2013 Lee ..... C02F 1/002 215/316
2013/0119065 A1 * 5/2013 Buck ..... A47G 19/2205 220/523
2013/0199989 A1 * 8/2013 Carter ..... A47G 19/2266 210/464
2013/0228486 A1 * 9/2013 Buck ..... B65D 21/0238 206/459.1
2014/0232022 A1 * 8/2014 Chung ..... B05B 15/065 261/78.1
2014/0251938 A1 * 9/2014 Rose ..... B65D 51/28 215/6
2014/0263453 A1 * 9/2014 Haley ..... B65D 39/00 222/152
2015/0076050 A1 * 3/2015 May ..... A47G 19/2272 210/232
2015/0173540 A1 * 6/2015 Albers ..... B65B 3/045 220/715
2015/0232318 A1 * 8/2015 Meldeau ..... B67D 3/0019 222/189.06
2015/0251795 A1 * 9/2015 Tsui ..... A45C 7/0031 215/306
2015/0374169 A1 * 12/2015 Salas-de la Cruz .. A47J 31/605 99/290
2015/0375834 A1 * 12/2015 Rowden ..... A61H 37/005 441/130
2016/0075477 A1 * 3/2016 Halioua ..... B65D 25/04 222/566

* cited by examiner

PRESSURE-FITTED INSERTABLE DRINKING SPOUT ADAPTED FOR VARYING BOTTLE NECK SIZES

CROSS-REFERENCES TO RELATED APPLICATIONS

This application claims priority under 35 U.S.C. 19(e) to U.S. Patent App. No. 61/998,414, filed Jun. 27, 2014, entitled KIDDO KAP, by Ubaldo Garza, and to U.S. Patent App. No. 62/051,308, filed Sep. 17, 2014, entitled REUSABLE UNIVERSAL FIT BOTTLE CAP, by Ubaldo Garza, the contents of both being hereby incorporated by reference in their entirety.

FIELD OF THE INVENTION

The invention relates generally to beverage container tops, and more specifically, to an insertable drinking spout that pressure fits to bottle necks of varying sizes.

BACKGROUND

Bottled beverages purchased by consumers come with generic tops. In general, bottles have a wide portion to store liquid and a narrower bottle neck to aid pouring or drinking. Different bottles have differently sized bottle necks that can be based on overall liquid volume, liquid type, composition, or use, for example. Included bottle tops are typically custom-sized to threads around the exterior of bottle necks.

Problematically, conventional bottle caps are not designed for reuse. In more detail, wine bottles use corks that expand when taken out and cannot be reused at all. Other caps are completely removed from the bottle for drinking, and are then have to be screwed back on to prevent spillage. Removable caps are susceptible to loss and are not practical for sports drinks or other situations in which users take small drinks of liquid many times. Some sports drinks do have pop-up caps that allow users to drink without removing the cap. But these sports caps cost more and thus are not always included. Moreover, most caps are generic in nature, making it difficult to distinguish identical bottles from each other, for example, at a gym or party.

What is needed is a robust drinking cap container that can be used to easily reseal bottles of varying sizes and to provide a drinking spout. Furthermore, the drinking cap should be customizable and fun with interchangeable topper of varying designs.

SUMMARY OF DISCLOSURE

The foregoing shortcomings of the prior art are solved with an apparatus and method providing a drinking cap to dispense liquid from, and to reseal any of, a plurality of bottles having bottle necks of varying sizes.

In an embodiment, a sealing portion of the cap seals in liquid to prevent spilling. The sealing portion can have a cone shape with a first diameter on a lower portion and a second diameter on an upper portion that is larger than the first diameter. The sealing portion can pressure fit the lower portion into a bottle neck of one of the plurality of bottles having bottle necks of varying sizes. The lower portion fits deeper into a bottle neck of a larger diameter than a bottle neck of a smaller diameter, for pressure-fitting the bottle necks of the large and small diameters with the same cone-shaped portion of the cap.

In another embodiment, a sipping portion of the cap provides a spout for consuming or pouring liquid. A first end is attached to the upper portion of the sealing portion. A second end has a plurality of holes to restrict the flow of liquid from the bottle through a third diameter that is smaller than the second diameter of the upper portion of the sealing portion.

In yet another embodiment, an attached cover of the cap closes the sipping portion. The attached cover can flexibly connect to the sealing portion with a connector long enough to reach the sipping portion. The attached cover pressure fits over the second end of the sipping portion to prevent liquid from spilling through the plurality of holes.

Still other embodiments convert a cavity in the drinking cap to store liquid or powder concentrate for mixing in liquid from the bottle. Designer tops customize drinking caps. Some designer tops are interchangeable and snap on to a pressure decoupling cap. Additionally, a water filter can purify liquid while being consumed. Also, an adapter can extend the range of bottle necks for sealing.

Advantageously, a custom cap can be reused to seal and provide a spout universally to bottles.

BRIEF DESCRIPTION OF THE DRAWINGS

In the following drawings, like reference numbers are used to refer to like elements. Although the following figures depict various examples of the invention, the invention is not limited to the examples depicted in the figures.

DESCRIPTION

An apparatus and related method are disclosed for a drinking cap. In more detail, the drinking cap dispenses liquid from, and reseals any of a plurality of, bottles having bottle necks of varying sizes. Optional features discussed below can be implemented separately or in any combination to the baseline drinking cap.

The below description includes exemplary embodiments that are provided for illustration only and are not intended to limit implementation details of additional embodiments. One of ordinary skill in the art could apply the principles described to the additional non-included embodiments within the spirit of the invention as described. For example, although the description describes a drinking cap sealing from within a bottle neck, alternatives can seal from outside of the bottle neck.

Figure 1:
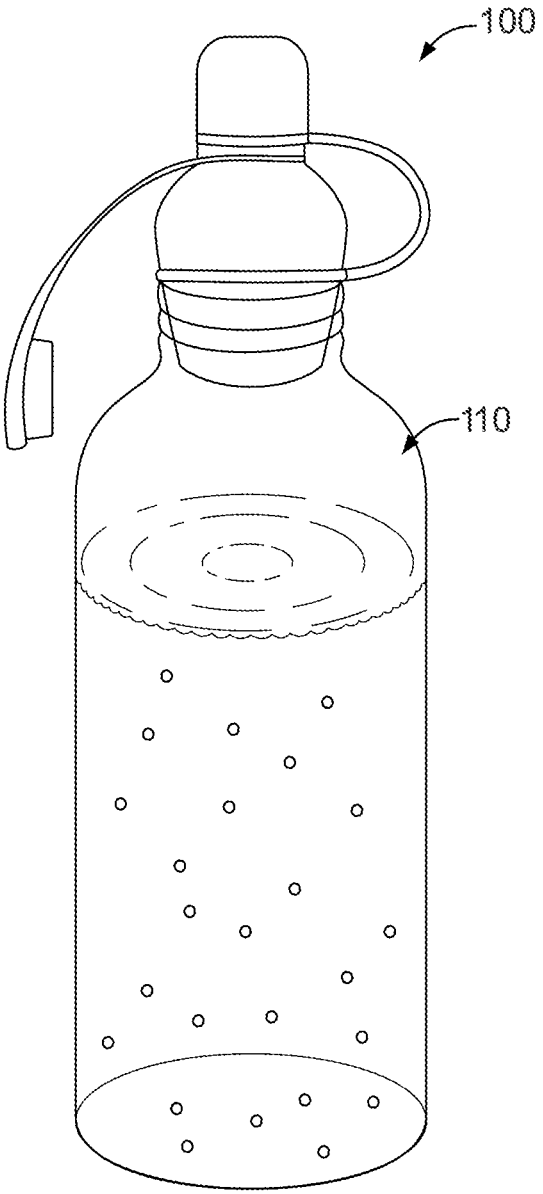
FIG. 1 is a schematic diagram illustrating a drinking cap pressure fitted on a bottle, according to one embodiment.

FIG. 1 is a schematic diagram illustrating a drinking cap 100 pressure fitted on a bottle 110, according to one embodiment. The drinking cap 100 seals the bottle 100 to prevent spilling and also allows liquid to be consumed more easily.

Figure 2B:
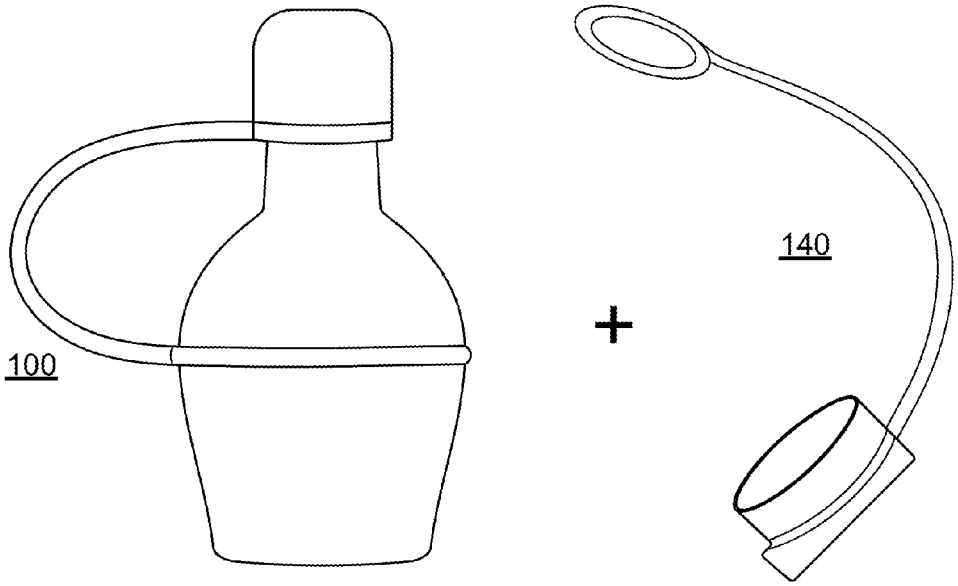
FIGS. 2A-2C are schematic diagrams illustrating the drinking cap and an integrated assembly for an optional bottom plug, according to one embodiment.
Figure 2A:
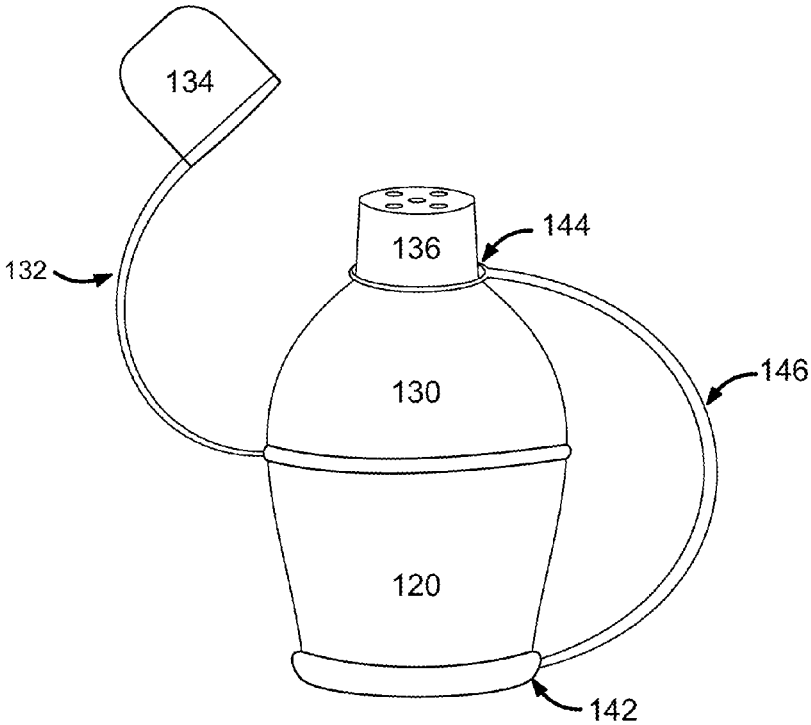
Figure 2C:
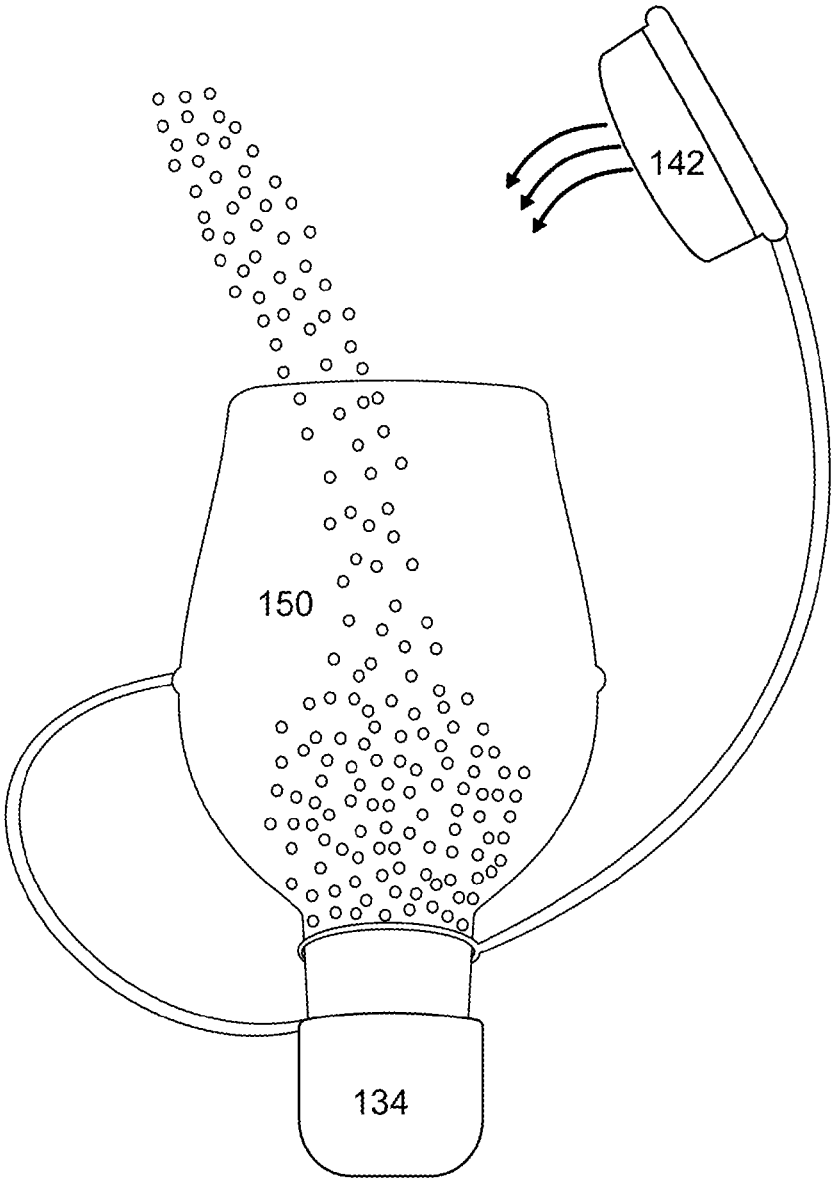

The drinking cap 100 is shown in more detail in FIGS. 2A-2C. More specifically, FIG. 2A shows a sealing portion 120 and a sipping portion 130 when separated. To join, a flexible connector 132 is attached to a joint between the sealing and sipping portions 120, 130 and extends so that a cap 134 can cover a spout 136 of the sipping portion 130. A bottom plug 140 has a plug 142 and a loop 144 on each side of a flexible connector 146. To integrate the bottom plug 140, the loop 144 is placed over the spout of the sipping portion 130 to hold in place, and the plug is pushed into the sealing portion 120 to close off an internal cavity formed by the sealing and sipping portions 120, 130. These components can be made of plastic, rubber, metal, a combination or any other appropriate material, and formed by being poured into a mold for cooling.

In more detail, the sealing portion 120 has a cone shape with a larger diameter at the top that decreases in size to a smaller diameter at the bottom. As a result, when the drinking cap 100 is pushed into a bottle, a seal is generated when a diameter of a bottle neck matches a diameter of the sealing portion 120. A bottle neck having a relatively small diameter will not accept much of the sealing portion 120 while a bottle neck having a relatively larger diameter will accept more of the sealing portion 120, for a deeper insertion. Some bottle necks may require an adapter as described below.

The sipping portion 130, in another embodiment, also has different diameter on each end. One diameter matches an upper portion of the sealing portion to form a joint. Another diameter is small to form the spout 136 for comfortable disbursement of liquid (e.g., for a human drinking liquid). The spout 136 can have holes to optimize the flow of liquid. Loss of the cap 134 is prevented by attachment to the drinking cap 100. The cap 134 can seal the spout 136 by a pressure fitting, threading, snapping on, or the like.

The bottom plug 140, in one embodiment, allows the drinking cap 100 to hold concentrated powder or liquid for mixing into a water bottle. A cavity 150 is formed by the sealing and sipping portions 120, 130. When turned upside down as in FIG. 2C with the cap 134 on, powder or liquid can be scooped or poured in and closed up with the plug 142. In some embodiments, stores can sell the drinking cap 100 packaged with a certain concentrate drink. For example, a health club may sell drinking caps 100 with protein powder for workout recovery. When ready for consumption, the plug is opened and the contents are poured into the bottle for mixing. The drinking cap 100 then switches from being a holding container to a sealer and sipper.

Figure 3A:
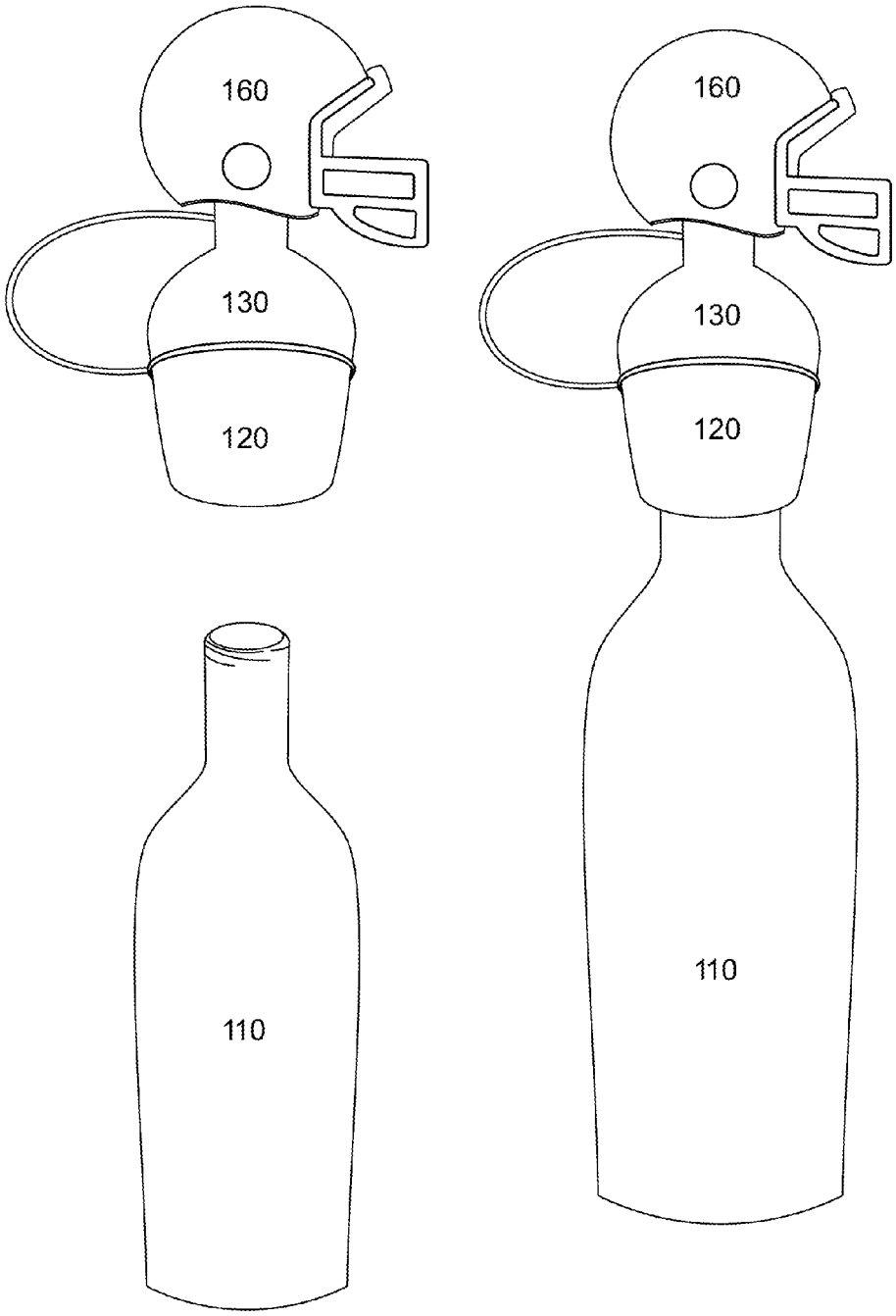
FIGS. 3A-3B are schematic diagrams illustrating optional designer tops attachable to the drinking cap, according to one embodiment.
Figure 3B:
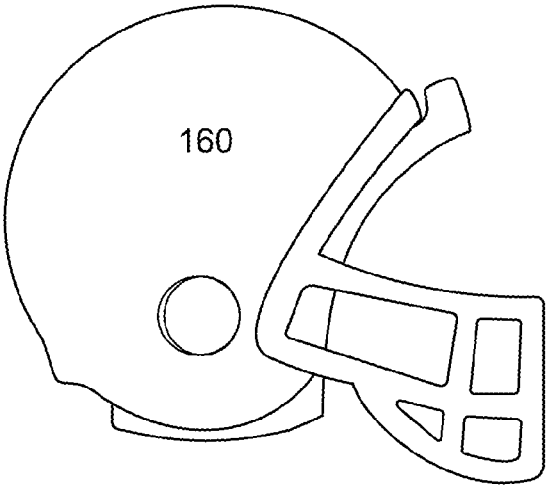
Figure 3B:
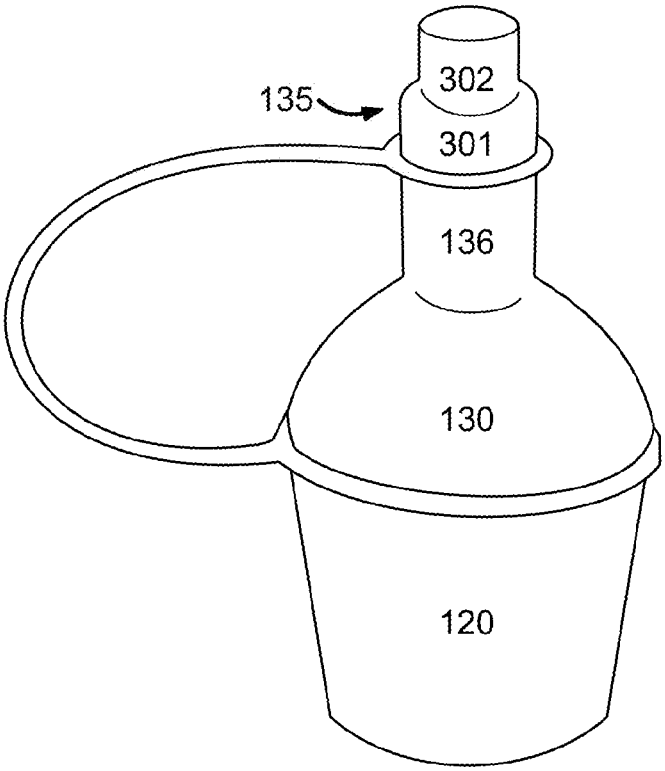

FIGS. 3A-3B are schematic diagrams illustrating an optional designer top 160 attachable to the drinking cap 100, according to one embodiment. The designer top 160 customizes and makes bottles easily identifiable when used to seal a bottle as shown in FIG. 3A. One embodiment of an interchangeable designer top 160 is shown in FIG. 3B. The designer top 160 can be taken on and off of the cap 134. The potential number of designs are infinite. A football helmet is shown in the illustrations, but other examples include cartoon characters, baseball helmets, different types of balls such as basketballs and baseballs, product advertisements, and more.

In one implementation, a beveled design decouples pressure from pressure fitting of the designer top 160 on the cap 134 from pressure from pressure fitting the cap 134 over the spout 136. In particular, a first portion 301 of the cap 134 is sized for the spout 136. A second portion 302 of the cap 134 is sized with a smaller diameter so that pressure from the designer top 160 does not transfer to the first portion 301, making it more difficult to put the cap 134 on and off of the spout 136. The beveled design can be implemented in any of the other embodiments of the Figures.

Figure 4A:
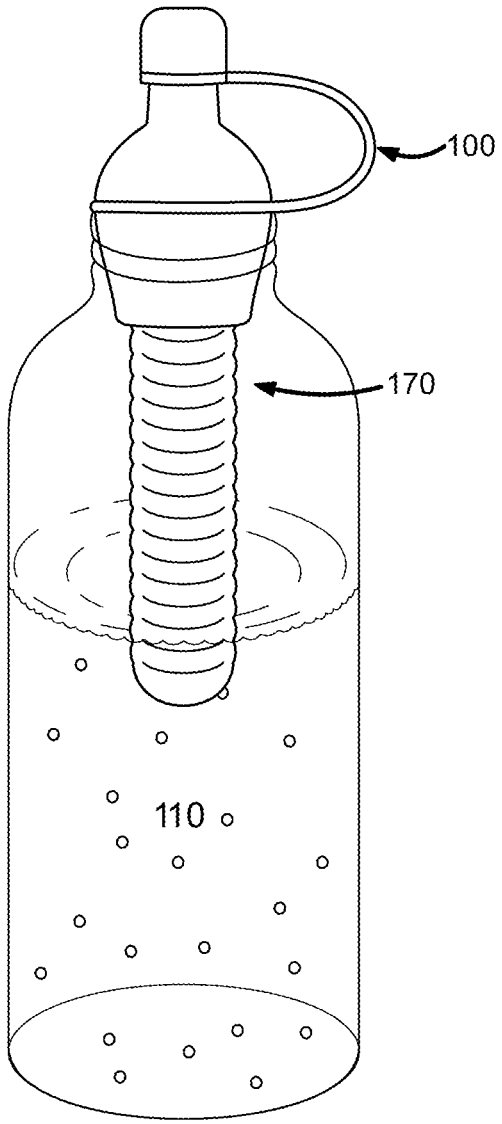
FIGS. 4A-4B are schematic diagrams illustrating an optional water filter attachable to the drinking cap, according to one embodiment.
Figure 4B:
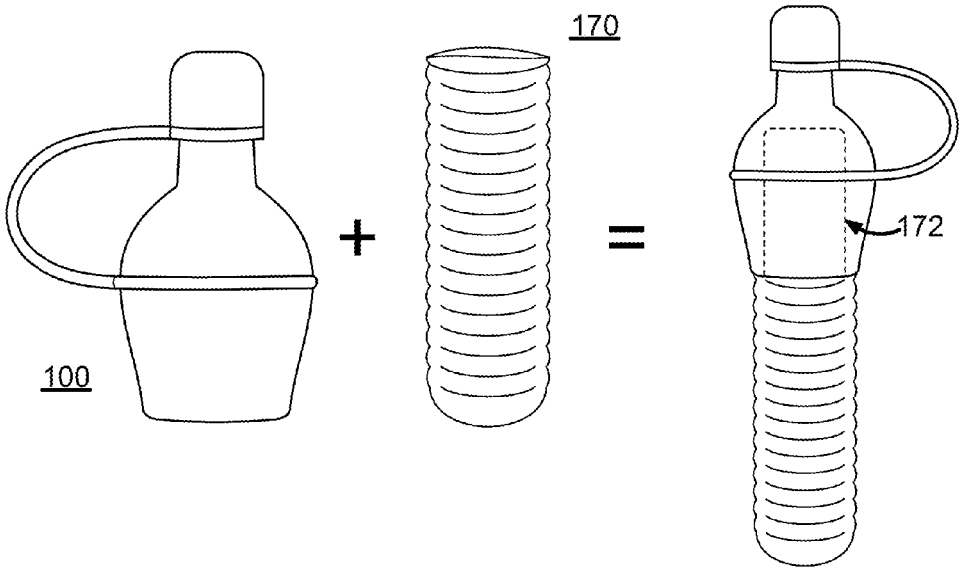

FIGS. 4A-4B are schematic diagrams illustrating an optional water filter 170 attachable to the drinking cap 100, according to one embodiment. Advantageously, water or liquid is purified as it is consumed from the drinking cap 100. A filter 170 attaches inside of the drinking cap 100 by snapping in 172, screwing in, pressure fitting, or by any other appropriate attaching mechanism. The filter 170 is easily removed from cleaning or for consumption without purification as desired by users. A charcoal filter or other type of changeable screen can be included inside the filter 170.

Figure 5:
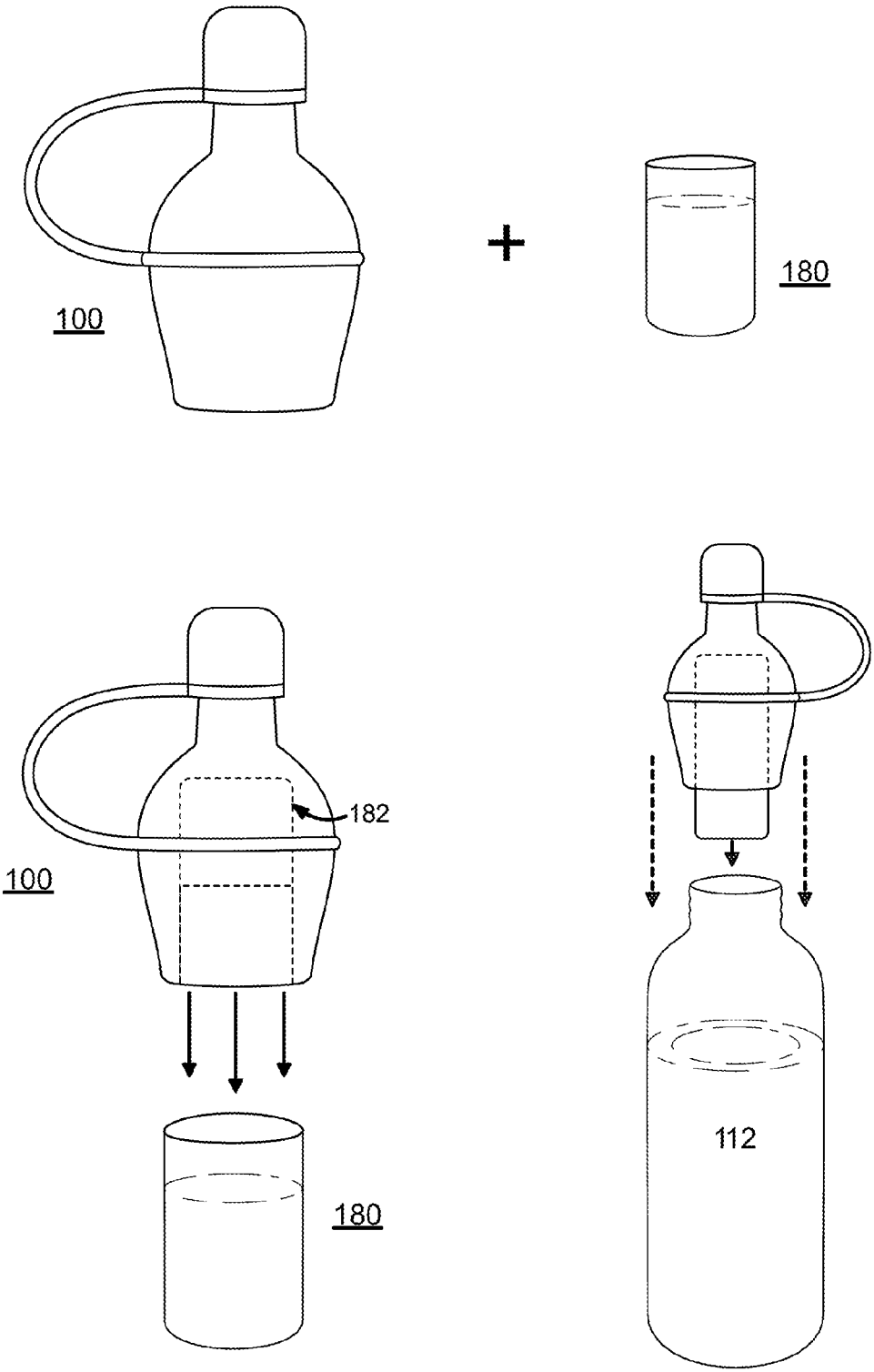
FIG. 5 is a schematic diagram illustrating an optional size adaptor for the drinking cap, according to one embodiment.

FIG. 5 is a schematic diagram illustrating an optional size adapter 180 for the drinking cap 100, according to one embodiment. The adapter 180 allows a one size fits all drinking cap 200 to be downsized even smaller for beverage containers such as 12-ounce single serving water bottles. The neck size is significantly smaller on single serving bottles compared to 2-liters or gallons such that the drinking cap 100 design may be too large or impractical to cover the full range. The adapter 180 snaps in 182 to reduce the diameter below the minimum size of the sealing portion 120. The adapter 180 can be a cylinder shape, or a cone shape to adapt to varying sized smaller bottle necks. In some embodiments, the adapter 180 is implemented in an over the neck version of the drinking cap 100.

Many other embodiments are possible. For example, one additional embodiment fits the drinking cap 100 over the outside of a bottle neck and is held in place by threads. Another embodiment includes an electronic volume tracker to indicate how much liquid has been consumed through the drinking cap 100. Still other embodiments have different shapes, for example, when no storage cavity is needed, the implementation can be more streamlined.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A drinking cap to dispense liquid from and to reseal any of a plurality of bottles having bottle necks of varying sizes, comprising:

a sealing portion of the cap adapted for sealing a bottle, the sealing portion having a cone shape with a first diameter on a lower portion and a second diameter on an upper portion that is larger than the first diameter, the sealing portion being adapted for a pressure fitting with the lower portion into a bottle neck of one of the plurality of bottles having bottle necks of varying sizes, wherein the lower portion fits deeper into a bottle neck of a larger diameter than a bottle neck of a smaller diameter for pressure-fitting the bottle necks of the large and small diameters with the same cone-shaped portion of the cap;

a sipping portion of the cap adapted for drinking, comprising a first end and a second end, the first end attached to the upper portion of the sealing portion, and the second end having a plurality of holes to restrict the flow of liquid from the bottle having a third diameter that is smaller than the second diameter of the upper portion of the sealing portion;

an attached cover of the cap adapted for closing the sipping portion, the attached cover being flexibly connected to the sealing portion with a connector long enough to reach the sipping portion, the attached cover pressure fit over the second end of the sipping portion to prevent liquid from spilling through the plurality of holes; and a water purifier component having a first end that connects to the lower portion of the cone shaped portion allowing purification of liquid immediately before being consumed through the sipping portion.

2. The drinking cap of claim 1, further comprising:

an interchangeable aesthetic component for attachment to an attached sipping portion, wherein the interchangeable aesthetic component is removable for replacement with a second interchangeable aesthetic component.

3. The drinking cap of claim 2, wherein the attached sipping portion comprises a first end and a second end in a beveled configuration, the first end allowing a pressure fit to the sipping portion at a first pressure and the second end allowing a pressure fit to the interchangeable aesthetic component at a second pressure, the second pressure being decoupled from the first pressure.

4. The drinking cap of claim 3, wherein the first end of the sipping portion has a first diameter and the second end of the sipping portion has a second diameter different from the first diameter, to allow the first pressure of the sipping portion to decouple from the second pressure of the sipping portion.

5. The drinking cap of claim 1, wherein the bottle necks of the large and small diameters correspond to one or more of: a water bottle, a soda bottle, a beer bottle, a single-serving drink bottle, a 2-liter drink bottle, and a gallon jug.

6. The drinking cap of claim 1, further comprising:

a bottom plug adapted to hold drink powder or liquid drink concentrate in the cap, the bottom plug having a fourth diameter allowing a seal of the first diameter on the lower portion of the sealing portion, wherein the drink powder or liquid drink concentrate is stored in a cavity formed by the cone-shaped portion and the sipping portion of the cap when the cap is not sealing a bottle.

7. The drinking cap of claim 6, wherein a second connector is flexibly connected to the bottom cap and an insert.

8. The drinking cap of claim 6, wherein a second connector comprises a loop at a first end and is flexibly connected to the bottom cap at a second end, the second connector being long enough to reach the sipping portion of the cap and the loop has a hole sized to fit through the sipping cap, the attached cover holding the loop in place when pressure fit over the second end of the sipping portion.

* * * * *